United States Patent [19]

Hentschel et al.

[11] Patent Number: 4,856,936

[45] Date of Patent: Aug. 15, 1989

[54] FORM FOR CONCRETE-PLACEMENT TUNNEL LINING

[75] Inventors: Volker Hentschel, Hildesheim-Itzum; Clemens Versteegen; Jens Glöyer, both of Essen; Siegmund Babendererde, Lübeck-Travemünde, all of Fed. Rep. of Germany

[73] Assignee: Hochtief Aktiengesellschaft Vorm. Gebr. Helfmann, Essen, Fed. Rep. of Germany

[21] Appl. No.: 213,636

[22] Filed: Jun. 30, 1988

[30] Foreign Application Priority Data

Jul. 25, 1987 [DE] Fed. Rep. of Germany ..... 37247697

[51] Int. Cl.[4] ..... E21D 11/10; E21D 9/06

[52] U.S. Cl. ..... 405/145; 405/141; 405/146; 405/150

[58] Field of Search ..... 405/141, 146, 147, 150

[56] References Cited

U.S. PATENT DOCUMENTS

| | | | |
|---|---|---|---|
| 3,877,855 | 4/1975 | Hanson | 475/59 |
| 4,099,388 | 7/1978 | Hüsemann et al. | 405/141 |
| 4,147,453 | 4/1979 | Unger et al. | 405/141 |
| 4,437,788 | 3/1984 | Walbröhl | 405/146 |
| 4,621,947 | 11/1986 | Babeudererde et al. | 405/146 |
| 4,710,058 | 12/1987 | Han | 405/146 |
| 4,768,898 | 9/1988 | Babendererde et al. | 405/150 |

FOREIGN PATENT DOCUMENTS

| | | |
|---|---|---|
| 3018851 | 11/1980 | Fed. Rep. of Germany . |
| 3043312 | 7/1982 | Fed. Rep. of Germany . |
| 2382578 | 9/1978 | France . |
| 2414116 | 8/1979 | France . |

*Primary Examiner*—Randolph A. Reese
*Assistant Examiner*—Arlen L. Olsen
*Attorney, Agent, or Firm*—Herbert Dubno

[57] ABSTRACT

A form for a concrete tunnel lining usable behind a tunnel excavator with a traveling shield is made of an inner tunnel-lining sheathing and a form front. The inner tunnel-lining sheathing is divided into a plurality of sheathing segments or rings movable independently of each other with intervening segment-bridging yieldable joints. The form front located between the traveling shield and the inner tunnel-lining sheathing is movable forwardly by the conrete which presses in the annular space formed by the traveling shield and/or the surrounding earth and by the inner tunnel-lining sheathing as well as the form front. An operationally beneficial design results when the inner tunnel-lining sheathing is set up for forward motion of the sheathing segments in the tunnel longitudinal direction singly or in groups one after the other relative to the remaining sheathing segments held or remaining at rest. The front can be supported additionally by at least one spring device held on cantilevered arms extending from the inner tunnel-lining form.

5 Claims, 2 Drawing Sheets

FORM FOR CONCRETE-PLACEMENT TUNNEL LINING

CROSS REFERENCE TO RELATED APPLICATIONS

This application is related to the copending applications: Ser. No. 07/032,334 filed 30 Mar. 1987, now patent No. 4,785,559; Ser. No. 07/061,864, filed 11 June 1987, now patent No. 4,768,898; Ser. No. 07/129,655, filed 7 Dec. 1987; Ser. No. 07/157,848, filed 18 Feb. 1988 and Ser. No. 07/175,191, filed 30 Mar. 1988.

FIELD OF THE INVENTION

Our invention relates to a formwork which is used to make a concrete tunnel lining and which can be used with a tunnel excavator but may be used independently thereof for the concrete emplacement phase.

BACKGROUND OF THE INVENTION

A form for a concrete tunnel lining can comprise a traveling shield following an excavating head and advanced therewith.

This form comprises an inner tunnel-lining sheathing and a form forwardly movable annular front. The inner tunnel-lining sheathing is subdivided into a plurality of independently movable sheathing member or segments with intervening segment-bridging joints. The form front positioned between the inner tunnel-lining sheathing and the traveling shield is movable forward by the pressure of the concrete which is forced into an annular space formed by the traveling shield, the surrounding earth, the inner sheathing segments and by the form front.

In the known form as taught in German Open Patent application No. 30 43 312 the inner tunnel-lining sheathing together with the form front is equipped for a complete forward motion by the pressure of the forced in concrete. That requires a comparatively high concrete pressure along with correspondingly high pressure fluctuations which impair the quality of the tunnel lining.

OBJECTS OF THE INVENTION

It is an object of our invention to provide an improved form for a concrete tunnel lining which does not have the above mentioned disadvantage and drawback.

It is also an object of our invention to provide an improved form for a concrete tunnel lining which has a minimal affect upon the quality of the emplaced concrete tunnel lining.

It is another object of our invention to provide an improved form for a concrete tunnel lining which results in a tunnel lining having an improved quality.

SUMMARY OF THE INVENTION

These objects and others which will become more readily apparent hereinafter are attained in accordance with our invention in a form for a concrete tunnel lining usable behind a tunnel excavator with a traveling shield comprising an inner tunnel-lining sheathing and a form front, the inner tunnel-lining sheathing being divided into a plurality of independently movable sheathing segments with a plurality of intervening segment-bridging yieldable joints and the form front positioned between the inner tunnel-lining sheathing and the traveling shield being movable forward by the concrete which can be forced into an annular space formed by the traveling shield, the inner sheathing segments, the surrounding earth and by the form front.

According to our invention the inner tunnel-lining sheathing is set up for forward motion of at least one of the sheathing segments singly or as a group of such segments one after the other relative to the remaining sheathing segments held and/or remaining at rest.

We have found it to be possible to eliminate the problems depicted at the outset when a stepwise forward motion is performed by at least one of the inner sheathing segments in which the supporting forces required for forward motion of one or more sheathing segments are carried or borne by the sheathing segments remaining at rest and the friction of these segments in the previously emplaced concrete and/or the earth. This form has proven suitable in practice. Of course, the frictional resistance to movement of the movable segments must be less than the resistance to movement of the segments against which the movable segment is braced for its movement.

The inner tunnel-lining sheathing can be made of a plurality of sheathing segments or rings with intervening elastic joint inserts so that the inner tunnel-lining sheathing and/or the sheathing segments can be released from the already hardened concrete and/or pressed against it. Significantly the sheathing rings can be made of a plurality of arc-segmental sheathing elements elastically jointed with each other. The rings can have relative angular orientations that are fixable and adjustable by an adjusting device, e.g. a hydraulic piston-cylinder device. In this way an adjustment of the sheathing rings to a radius or curve of the form is allowed and/or the flexibility is improved.

In one embodiment of our invention, the sheathing segments are each supported by at least one sliding longitudinal guide with an associated hydraulic or pneumatic jack mounted or held in a supporting frame of the form and are movable forwardly with a feed piston-cylinder device in the longitudinal tunnel direction.

To obtain a structure which is particularly compact, the apparatus can have one of the feed piston-cylinder devices located or mounted between a front and a rear sliding longitudinal guide and/or a front and a rear hydraulic or pneumatic jack of each sheathing member. The form front can be braced by at least one adjustable spring device mounted on a cantilevered arm of the supporting frame so that the form can be used altogether independently of the tunneling excavator.

In another advantageous embodiment of our invention the sheathing segments are made from a plurality of sheathing rings spaced from each other in the tunnel longitudinal direction successively which are attached to each other by jointed feed piston-cylinder devices and are movable.

In this embodiment the inner tunnel-lining sheathing is moved forwardly with a peristaltic movement (i.e. in increments around the periphery). So that an individual sheathing ring can not be moved forward excessively relative to the others, the sheathing rings are guided appropriately on longitudinal supports. Here also, the form front can be supported by at least one adjustable spring device held on the cantilevered arms of the tunnel form, e.g. of the first sheathing ring, to allow its use independently of the tunnel excavator.

BRIEF DESCRIPTION OF THE DRAWING

The above and other objects, features and advantages of our invention will become more readily apparent from the traveling description, reference being made to the accompanying highly diagrammatic drawing in which.

SPECIFIC DESCRIPTION

Figure 1:
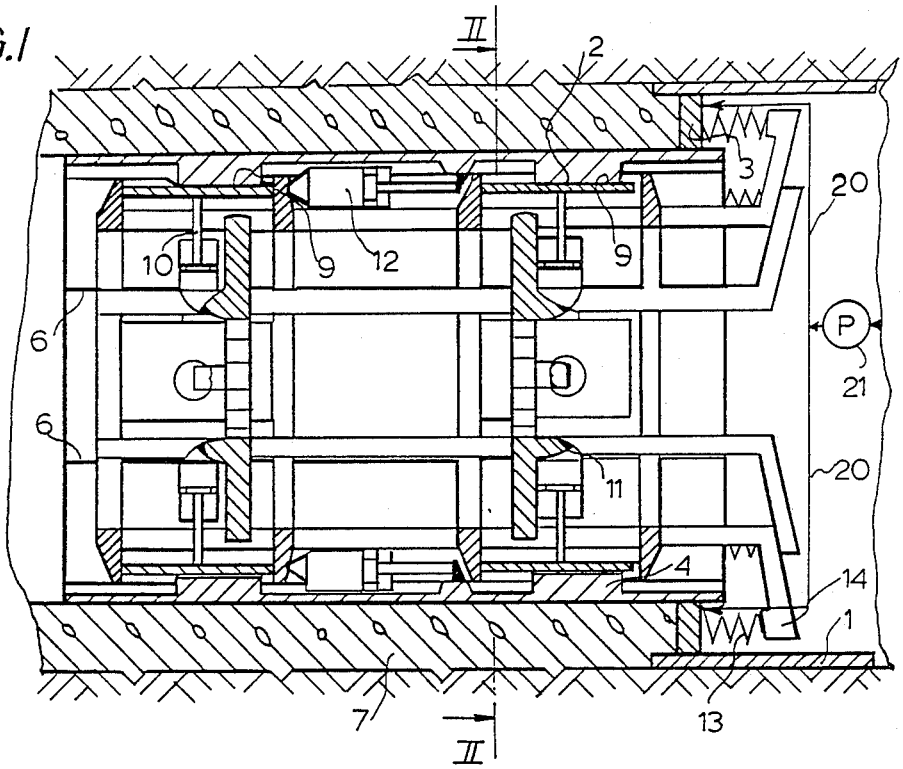
FIG. 1 is a longitudinal cross sectional view through one embodiment of a form according to our invention.

The forms shown in the drawing are designed for lining a tunnel by concrete emplacement and are usable behind a tunnel excavator with a traveling shield 1 but also are usable without the excavating machine.

This form basically comprises an inner tunnel-lining sheathing 2 and a form front 3. The inner tunnel-lining sheathing 2 is subdivided up into a plurality of independently movable sheathing segments 4 and/or 5 with a plurality of intervening segment-bridging yieldable joints 6 or 6'.

The segment-bridging yieldable joint 6 can amount to an elastic insert, a sheet metal or a similar structure.

The form front 3 positioned between the traveling shield 1 and the inner tunnel-lining sheathing 2 is movable forward by the concrete which is forced into the annular space 7 which is formed by the traveling shield 1 and/or the surrounding earth and by the inner tunnel-lining sheathing 2 and the form front 3.

The concrete is forced in through flexible hoses 20 through the form front 3.

In all cases the inner tunnel-lining sheathing 2 is arranged for forward motion of the sheathing segments 4 and/or 5 singly or in groups one after the other relative to the remaining sheathing segments 4 and/or 5 held and/or remaining at rest.

Figure 2:
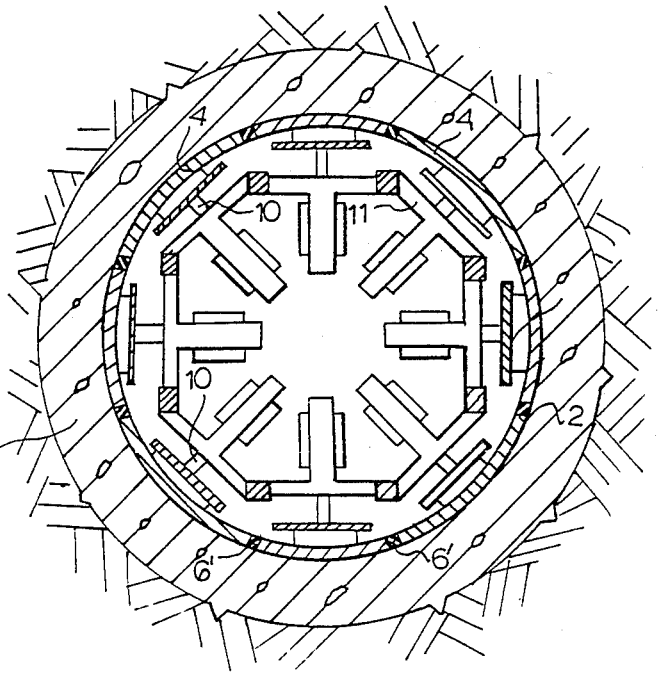
FIG. 2 is a cross sectional view taken along the section line II—II of FIG. 1.
Figure 4:
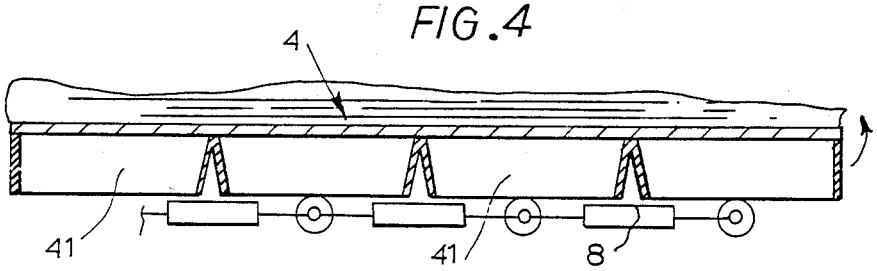
FIG. 4 is a cross sectional view of a portion of a form drawn to a larger scale.

As can be seen especially from FIG. 2 the inner tunnel-lining sheathing 2 is constructed from a plurality of sheathing segments 4 with intervening segment-bridging yieldable joints 6 which in this case are longitudinal elastic joint inserts. FIG. 4 shows an assembly allowing improvements in regard to flexibility; accordingly the sheathing segments 4 are constructed as a plurality of sheathing segments 41 jointed pivotally or hingedly to each other whose relative angular orientations are adjustable and fixable with a plurality of adjusting devices 8. Here each of the adjusting devices is a hydraulic piston-cylinder device 12.

In the embodiment according to FIGS. 1 and 2 the sheathing segments 4 are each supported by two sliding longitudinal guides 9 with associated hydraulic or pneumatic jacks 10 in a supporting frame 11 and are movable with the help of a feed piston-cylinder device 12 in the tunnel longitudinal direction. The feed piston-cylinder device 12 is mounted between a front and a rear sliding longitudinal guide 9.

In other words, two sliding longitudinal guides 9 and/or the associated hydraulic or pneumatic jacks 10 are provided per sheathing member 4; with the help of the hydraulic or pneumatic jack 10 the sheathing member 4 can be loaded and/or unloaded radially.

The form front 3 is braced or supported by adjustable spring devices 13 which are each on a cantilevered arm 14 of the supporting frame 11. The spring device 13 can comprise a hydraulic piston-cylinder device whose front cylinder chambers are supplied by a hydraulic fluid from a hydraulic line of a pressurized gas cushion unit.

Figure 3:
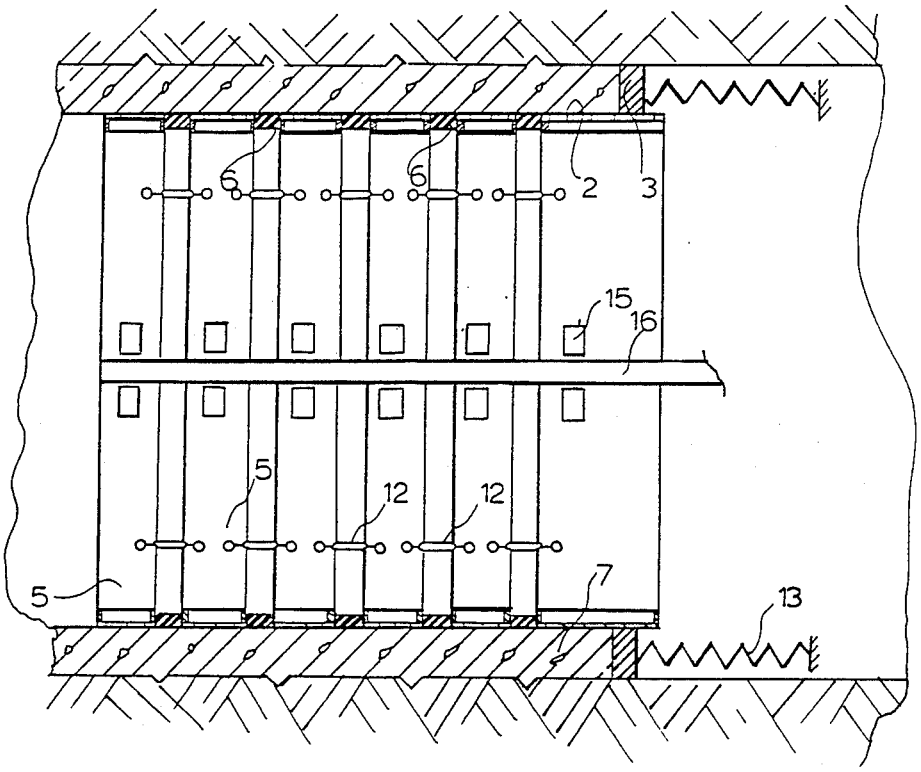
FIG. 3 is a longitudinal cross sectional view through another embodiment of a form for a concrete tunnel-lining according to our invention.

In the embodiment shown in FIG. 3 the sheathing segments comprise sheathing rings 5 spaced from each other in the tunnel longitudinal direction which are attached to each other pivotally or hingedly by feed piston-cylinder devices 12 and which are movable like the tubing in a peristaltic pump. To prevent the giving way of an individual sheathing ring 5, the sheathing rings 5 are guided with guide members 15, e.g. supporting rollers on a longitudinal support 16. It is understood that the guide members 15 are formed so that pivotal linkage between them is possible.

The operation of the apparatus is easily seen from the drawing. In FIGS. 1 and 2 the sheathing segments 4 are movable and in the example according to FIG. 3 the sheathing rings 5 are movable individually or in groups. Essentially, the frictional forces occurring between the concrete and the sheathing segments 4 and/or 5 remaining at rest are continuously larger than the corresponding forces of the sheathing segments 4 and/or 5 moving forward. By radially unloading and/or loading of the sheathing segments 4 and/or 5 (via jacks 10) all of these members may be made displaceable or held against displacement as desired.

We claim:

1. In a form of a concrete tunnel lining with a traveling shield, said form comprising an inner tunnel-lining sheathing and a form front, said inner tunnel-lining sheathing being divided into a plurality of independently movable sheathing segments with a plurality of intervening segment-bridging yieldable joints and said form front positioned between said inner tunnel-lining sheathing and said traveling shield being movable forward by said concrete which is forcible into an annular space formed by said traveling shield and/or the surrounding earth and by said form front, the improvement wherein said inner tunnel-lining sheathing is constructed and arranged with means for forward motion of at least one of said sheathing segments or at least two of said sheathing segments singly or in groups one after the other relative to remaining sheathing segments at rest, and wherein said means for forward motion includes that said sheathing segments are each supported by at least one separate sliding longitudinal guide with a hydraulic or pneumatic jack held in a supporting frame to support each of said sheathing segments and allow said segments to be movable with the help of a feed piston-cylinder device in the tunneling direction said form front is supported by at least one adjustable spring device on a cantilevered arm of said supporting frame.

2. The improvement according to claim 1 wherein said inner tunnel-lining sheathing is made from a plurality of said sheathing segments with a plurality of intervening elastic longitudinal joint inserts as said intervening segment-bridging yieldable joints.

3. The improvement according to claim 2 wherein each of said plurality of sheathing segments are jointedly or hingedly connected with each other and said plurality of sheathing segment'3 s relative angular orientation is adjustable or fixable with the help of an adjusting device.

4. The improvement according to claim 1 wherein said feed piston-cylinder device is located or mounted between a front and a rear one of said sliding longitudinal guides.

5. A form for a concrete tunnel lining usable behind a tunnel excavator with a traveling shield comprising:

a form front; and an inner tunnel-lining sheathing comprising a plurality of independently movable sheathing segments, a plurality of intervening segment-bridging yieldable joints between said sheathing segments, said form front being positioned between said inner tunnel-lining sheathing and said traveling shield and being movable forward by said concrete which is forcible into an annular space formed by said traveling shield and/or the surrounding earth and by said form front, said sheathing segments being set up for forward motion singly or in groups one after the other relative to the remaining ones of said sheathing segments held and/or remaining at rest, at least two sliding longitudinal guides each with an associated radially movable hydraulic or pneumatic jack for each of said sheathing segments held in a supporting frame of said form, a plurality of feed piston-cylinder device each mounted between a front and a rear one of said sliding longitudinal guides acting substantially in the tunneling direction so that each of said sheathing segments is movable, and at least one adjustable spring device mounted on a cantilevered arm of said supporting frame supporting said form front.

* * * * *